US005083644A

United States Patent [19]

Collins, III

[11] Patent Number: 5,083,644

[45] Date of Patent: Jan. 28, 1992

[54] BRIEFCASE COVER

[76] Inventor: Cecil B. Collins, III, 250 Temple Dr., Bel Air, Md. 21014

[21] Appl. No.: 662,439

[22] Filed: Feb. 28, 1991

[51] Int. Cl.[5] ..... A45C 3/08; A45C 13/00; A45C 13/40

[52] U.S. Cl. ..... 190/26; 190/102; 150/105; 150/154; 383/111

[58] Field of Search ..... 190/26, 125, 100, 102; 150/105, 154, 104; 383/111

[56] References Cited

U.S. PATENT DOCUMENTS

| | | | |
|---|---|---|---|
| 451,843 | 5/1891 | Powell | 190/102 |
| 656,707 | 8/1900 | Welshe | 190/26 |
| 796,286 | 8/1905 | Botteese | 190/26 |
| 1,526,839 | 2/1925 | Dempsey | 190/26 |
| 1,783,275 | 12/1930 | Berwin | 190/102 |
| 2,319,729 | 5/1943 | Ford | 190/102 |
| 2,432,365 | 12/1947 | Allen | 190/26 X |
| 2,617,504 | 11/1952 | Meyers | 190/26 |
| 2,647,595 | 8/1953 | Meyers | 190/26 |
| 2,711,234 | 6/1955 | Robens | 190/26 |
| 2,781,113 | 2/1957 | Seeman | 190/102 |
| 3,704,738 | 12/1972 | Le Compte . | |
| 4,178,977 | 12/1979 | Sur et al. . | |
| 4,745,769 | 5/1988 | Wooden . | |

FOREIGN PATENT DOCUMENTS

| | | | |
|---|---|---|---|
| 157027 | 9/1939 | Austria | 150/154 |
| 1532842 | 7/1969 | Fed. Rep. of Germany | 150/154 |
| 214516 | 7/1941 | Switzerland | 150/154 |
| 2147497 | 5/1985 | United Kingdom | 190/100 |

*Primary Examiner*—Sue A. Weaver

[57] ABSTRACT

A flexible foldable cover for a briefcase to shield the briefcase exterior surface from the damaging effects of rain. The cover is a rectangular bottomless hood structure having interior dimensions slightly greater than the exterior dimensions of the briefcase, such that the hood structure can be slipped downwardly over the briefcase when there is a threat of rain. When the cover is not needed it can be folded into a small size package and stored in the briefcase.

1 Claim, 1 Drawing Sheet

BRIEFCASE COVER

BACKGROUND AND SUMMARY OF THE INVENTION

This invention relates to a cover for a leather briefcase. The cover is designed for use in rainy inclement weather to protect the briefcase material from discoloration or deterioration due to contact with rain or snow.

It is already known to provide protective hoods or covers for various items. U.S. Pat. No. 3,704,738 to F. LeCompte discloses a flexible cover for a capstan on the deck of a sailboat. U.S. Pat. No. 4,745,769 to O. Wooden shows a foldable cover for an air conditioner apparatus. U.S. Pat. No. 4,179,977 to F. Sur et al shows a molded two piece cover for a lawnmower. I am not aware of any prior art covers for use on (over) a briefcase.

The present invention concerns a rectangular bottomless cover adapted to be slipped downwardly over a briefcase to protect the outer surfaces of the briefcase from rain or snow or possibly heavy soot or dust. The cover has a hood configuration mated to the size of the briefcase so that it can be readily slipped downwardly over the briefcase or drawn upwardly off the briefcase. The cover is formed of thin flexible sheet material so that it can be folded into a small size package and stored in the briefcase when it is not needed. Straps are attached to the cover for supporting a folded umbrella when the cover is in position on the briefcase. The person is able to have the umbrella readily available when rain is being forecast. At the onset of rain the person can remove the umbrella from the covered briefcase so that he or she is protected along with the briefcase.

THE DRAWINGS

FIG. 3 is taken prior to the sheet being folded into its final configuration.

DESCRIPTION OF A PREFERRED EMBODIMENT OF THE INVENTION

Figure 1:
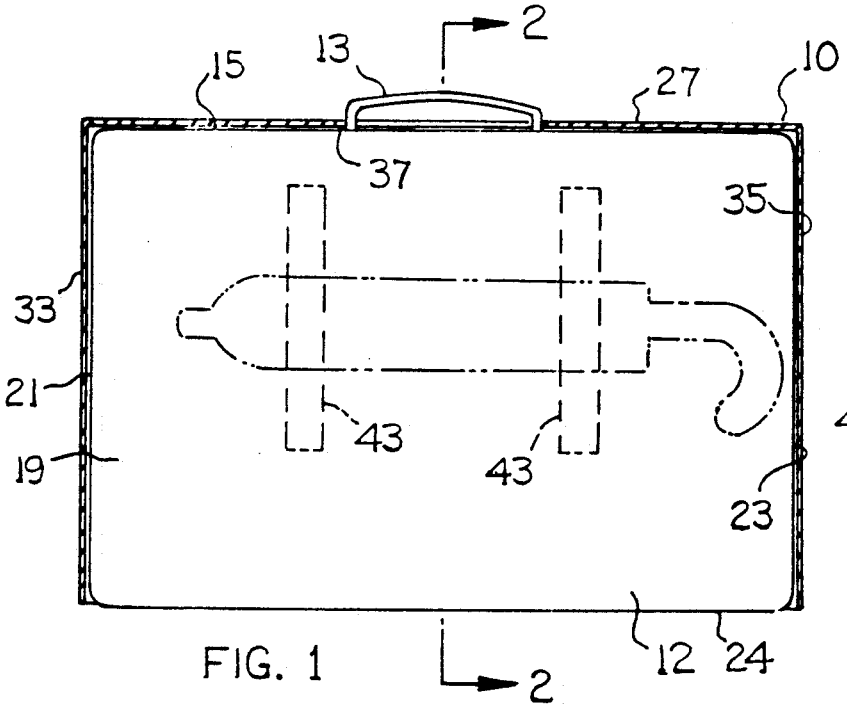
FIG. 1 is a sectional view taken through a cover embodying the invention. The cover is shown installed on (over) a conventional briefcase.
Figure 2:
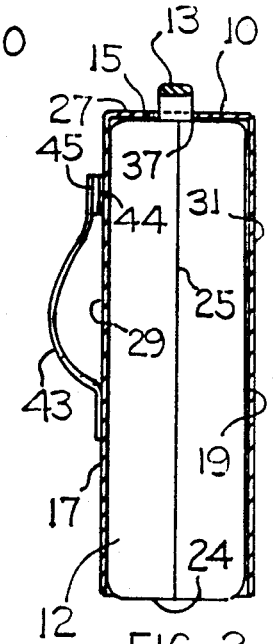
FIG. 2 is a sectional view taken on line 2—2 in FIG. 1.

FIGS. 1 and 2 show a cover 10 installed over a conventional leather briefcase 12. The briefcase is shown in an upright position, with a carrying handle 13 projecting upwardly from top wall 15. The briefcase has two flat side walls 17 and 19, and two end walls 21 and 23, as well as a bottom wall 24. As seen in FIG. 2, the briefcase is split along its midplane 25 into two half sections; the half sections being hingedly connected at bottom wall 24 so that the briefcase can be opened for access to the interior space within the briefcase. The briefcase is of standard construction, preferably comprising two steel shells having a leather outer layer for ornamental purposes.

The present invention relates to the protective cover 10 for the briefcase. The cover can be formed of a durable lightweight waterproof sheet material such as woven dacron or nylon. The sheet material is preferably treated with a water repellant waterproofing compound so that it will shed water without becoming water-soaked. The purpose of the cover is to protect the outer leather layer on the briefcase against discoloration or deterioration due to contact with rain, snow, or dirt. The cover will be installed on the briefcase when inclement weather is expected. At other times the cover can be stored in a folded condition in the briefcase.

Cover 10 is formed into a rectangular bottomless hood structure that includes a top panel 27, two side panels 29 and 31, and two end panels 33 and 35. The lower edges of the end panels and side panels are left unconnected.

A rectangular opening 37 is formed in top panel 27 to fit around handle 13 when the cover is installed onto the briefcase. The interior dimensions of the flexible cover will be slightly greater than the exterior dimensions of the briefcase, such that the cover can be readily slipped downwardly to enclose the briefcase (except bottom wall 24).

Figure 3:
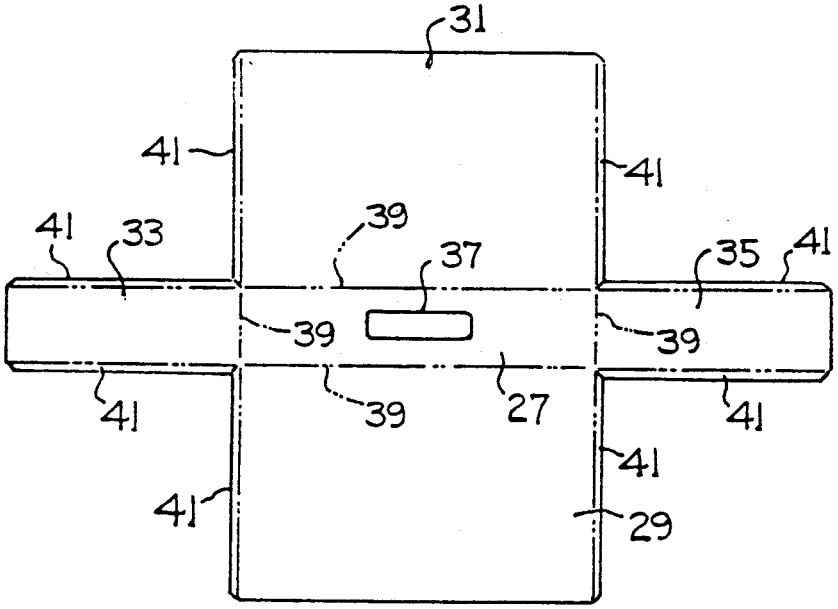
FIG. 3 is a plan view of a sheet of material used to form the FIG. 1 cover.

The flexible cover is preferably formed out of a single sheet of material FIG. 3 shows the outline of the sheet prior to its being folded and connected together. Dashed lines 39 show the fold lines between the edges of top panel 27 and the other four panels. End edges of the top panel form the upper edges of the end panels 33 and 35. Side edges of the top panel form the upper edges of the side panels 29 and 31.

Figure 4:
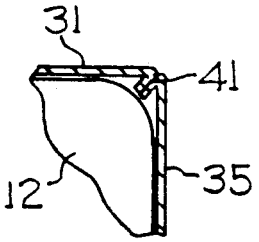
FIG. 4 is a fragmentary sectional view taken through a stitched edge connection used in the FIG. 1 cover.

Side edges of panels 29, 31, 33 and 35 are brought together and connected by stitching. The stitched areas are indicated by numeral 41 in FIG. 3. After the stitching operation on all four sides (corner areas) of the rectangular hood structure, the hood structure is preferably turned inside out so that the stitching is located on the inside of the hood structure, as shown in FIG. 4. Briefcases are commonly formed with rounded exterior corners. Therefore, there is space available within the interior corner areas of the cover to accommodate the stitching.

Flexible straps 43 are arranged on one face of the cover to provide a support for a folded umbrella. The lower end of each strap can be permanently attached to side panel 29, as by stitching. If each strap is formed of an elastic spandex material then the upper end of each strap can also be permanently attached to panel 29. However, if the strap material is non elastic the upper ends of the straps can be removably attached to panel 29 by patches of adhesive material marketed under the tradename VELCRO. Patch material of this type is comprised of miniature fibers having hook or loop ends that interlock to adhesively keep the patches together. In FIG. 2 numeral 44 designates an adhesive patch secured to panel 29; numeral 45 designates a second adhesive patch carried by a strap 43. The straps 43 are each appreciably longer than the distance between the upper and lower strap attachment points, so that each strap has sufficient slack therein for holding a folded umbrella against panel 29.

It is possible to add exterior pouches or pockets to the flexible cover for containment of items that might otherwise be carried within the briefcase. However, such pockets add some bulk to the cover, and thus tend to prevent it from being folded into a small size package for storage in the briefcase. The use of add-on pouches or pockets is therefore only an option. The invention can be practiced without such pouches or pockets.

I claim:

1. A flexible cover for a briefcase, wherein the briefcase has a top wall, two side walls, two end walls, and a carrying handle projecting from the top wall: said flexible cover comprising flexible impervious sheet material formed into a rectangular bottomless hood structure; said hood structure having a top panel positionable on the top wall of the briefcase, two side panels positionable against the side walls of the briefcase, and two end panels positionable against the end walls of the briefcase; the lower edges of the side panels and the end panels being unconnected, such that the hood structure can be slipped downwardly over the briefcase or drawn upwardly off of the briefcase; said top panel having an opening therein adapted to fit around the handle of the briefcase; and two parallel straps carried on one of the cover side panels; said straps having end areas thereof attached to said one side panel; each strap being appreciably longer than the distance between its attachment points, whereby each strap has sufficient slack therein for holding an umbrella against said one side panel.

* * * * *